United States Patent [19]

Honegger

[11] Patent Number: 4,641,795

[45] Date of Patent: Feb. 10, 1987

[54] PRINTED PRODUCT COIL

[75] Inventor: Werner Honegger, Tann-Rüti, Switzerland

[73] Assignee: Ferag AG, Hinwil, Switzerland

[21] Appl. No.: 732,585

[22] PCT Filed: Sep. 19, 1984

[86] PCT No.: PCT/CH84/00147

§ 371 Date: May 10, 1985

§ 102(e) Date: May 10, 1985

[87] PCT Pub. No.: WO85/01279

PCT Pub. Date: Mar. 28, 1985

[30] Foreign Application Priority Data

Sep. 19, 1983 [CH] Switzerland ..... 5068/83
May 9, 1984 [CH] Switzerland ..... 2267/84

[51] Int. Cl.[4] ..... B65H 75/02; B65H 16/02; B21C 47/24; B65G 65/00

[52] U.S. Cl. ..... 242/59; 242/68.5; 242/79; 414/606; 414/619; 414/910

[58] Field of Search ..... 242/59, 68.5, 79, 77.3, 242/58.6, 68.6; 414/910, 911, 606, 618, 619; 206/408, 415, 416

[56] References Cited

U.S. PATENT DOCUMENTS 1,908,108 5/1933 Boldman et al. ..... 242/68.6
2,223,682 12/1940 Gammeter ..... 242/68.6
2,694,534 11/1954 Stingle ..... 242/68
3,426,892 2/1969 Poncy ..... 242/68.5 X
3,680,806 8/1972 Obermaier et al. ..... 242/68.5 X
4,402,467 9/1983 Kontz ..... 242/58.6 X
4,438,618 3/1984 Honegger ..... 242/59 X

FOREIGN PATENT DOCUMENTS 165247 5/1954 Australia .
264304 12/1963 Australia .
559691 3/1975 Switzerland ..... 242/59

OTHER PUBLICATIONS

J. Jagr, "Grapple for Elevating Convoluted Rolls of Material", Apr. 1975, Western Electric Technical Digest No. 38, pp. 19–20.

*Primary Examiner*—Stuart S. Levy
*Assistant Examiner*—Thomas R. Hannon
*Attorney, Agent, or Firm*—Werner W. Kleeman

[57] ABSTRACT

A printed product coil or wound product package consists of a hollow winding core or mandrel upon which mutually slightly overlapping printed products as well as a winding band or partitioning strap wound in between the winding layers are wound-up. The winding band is maintained under tension and holds the coil together. The winding core has a lesser width than the printed products which means that the winding core is recessed in relation to the end faces of the printed product coil and permits stacking a series of the printed product coils with their end faces in intimate contact.

10 Claims, 9 Drawing Figures

PRINTED PRODUCT COIL

CROSS-REFERENCE TO RELATED APPLICATION

This application is related to the commonly assigned, copending U.S. application Ser. No. 649,371, filed Sept. 11, 1984, entitled "WINDING MANDREL FOR A COIL OR WOUND PACKAGE FORMED OF FLEXIBLE, SUBSTANTIALLY FLAT PRODUCTS, ESPECIALLY PRINTED PRODUCTS", and listing as the inventor Werner Honegger.

BACKGROUND OF THE INVENTION

The present invention broadly relates to a printed product coil or wound product package and, more specifically, pertains to a new and improved construction of a wound product package containing a winding core.

Generally speaking, the wound product package of the present invention comprises a cylindrical winding core, printed products wound-up upon the cylindrical winding core and a winding band or partitioning strap maintained under tension and wound in between the winding layers.

As known from the German Pat. No. 3,123,888 or the corresponding U.S. Pat. No. 4,438,618, such printed product coils or wound product packages are fabricated by winding up upon a winding core the printed products usually arriving in imbricated formation conjointly with a winding band maintained under tension. After completion, these product coils are usually transported to an intermediate storage area from which they are later delivered to a further processing station at which the printed products are again unwound from the winding core. The need therefore exists of being able to manipulate the product coils in the simplest possible manner and to spatially store them economically.

It is known from the Swiss Pat. No. 559,691 to employ a hollow cylindrical winding core with discoidal side flanges which are constructed as supporting and rolling rims for transporting the coil. These side flanges further serve to laterally support the wound-up printed products. Considerable space is required for storing such printed product coils due to these side flanges not only in height and width, but also in the direction of the longitudinal axis of the winding core, since the dimension of the coil in the axial direction of the winding core is greater than the width of the wound-up printed products.

It is also proposed in the above-mentioned Swiss Pat. No. 559,691 to employ hollow cylindrical winding cores which comprise a side flange on only one end and which are further provided with a stub shaft protruding beyond the side flange. A plurality of wound or unwound winding cores can be placed in flush contact due to this stub shaft and can be stored with the longitudinal axis extending either in vertical or horizontal direction. This known solution, too, has the disadvantage that when storing the product coil, relatively much space is required. Furthermore, the juxtaposition and separation of the individual product coils renders suitable equipment necessary, not least because of the weight.

SUMMARY OF THE INVENTION

Therefore, with the foregoing in mind, it is a primary object of the present invention to provide a new and improved construction of a printed product coil or wound product package which does not exhibit the aforementioned drawbacks and shortcomings of the prior art constructions.

Another and more specific object of the present invention aims at providing a new and improved construction of a printed product coil or wound product package of the initially mentioned type which can be transported, i.e. can be transferred between the processing location and the intermediate storage area, in simple manner and which furthermore permits space-saving intermediate storage. Yet a further significant object of the present invention aims at providing a new and improved construction of a printed product coil or wound product package of the character described and having a winding core which is relatively simple in construction and design, extremely economical to manufacture, highly reliable in performing its coil winding operation, not readily subject to breakdown and malfunction and requires a minimum of maintenance and servicing.

Since the winding core or mandrel does not protrude beyond any of the end faces of the coil, it is possible to stack the printed product coils in space-saving manner with their end faces lying flush together. The wound-up printed products are held firmly together by the winding band wound up with the printed products under tension. The high degree of compactness of the coil thus achieved permits forming the winding core narrower than the wound-up printed products without there being a danger of damaging the latter both during transport and during storage.

It is practical to provide the preferably hollow winding core or winding mandrel with means which permit the engagement of a transport device. This achieves the result that the coil can be transported without difficulty and without the necessity of complicated transport devices and can be furthermore lifted and lowered in a tilted orientation which permits juxtaposing the coils to a compactly lying stack.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
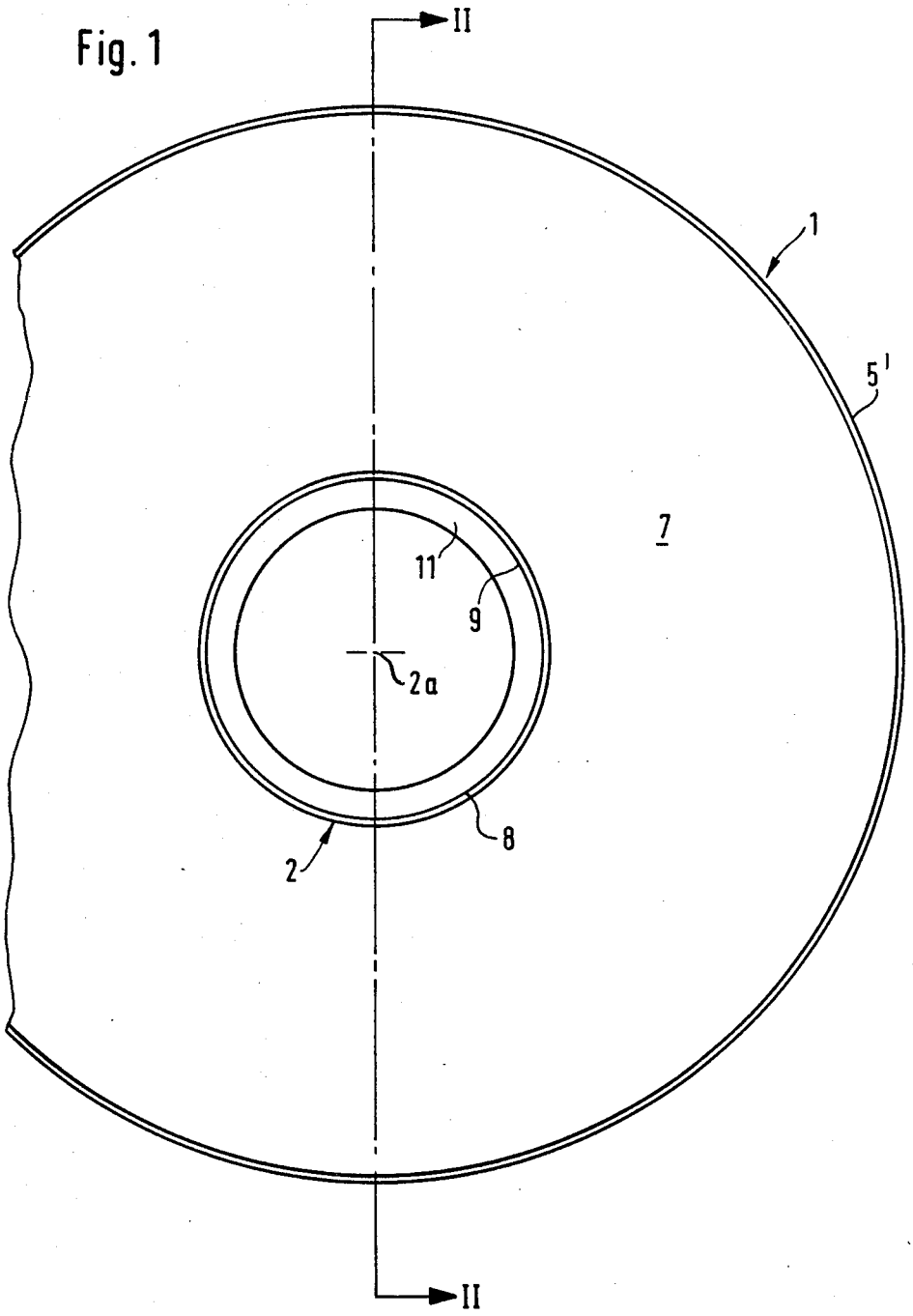
FIG. 1 schematically shows a printed product coil in frontal view.
Figure 2:
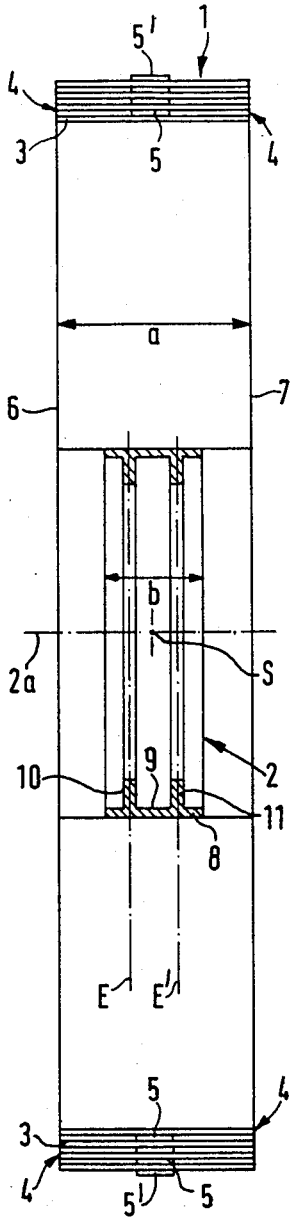
FIG. 2 schematically shows a section along the line II—II in FIG. 1.

Describing now the drawings, it is to be understood that to simplify the showing thereof only enough of the structure of the printed product coil or wound product package has been illustrated therein as is needed to enable one skilled in the art to readily understand the underlying principles and concepts of this invention. Turning now specifically to FIGS. 1 and 2 of the drawings, the printed product coil illustrated therein by way of example and not limitation will be seen to comprise a hollow winding core or mandrel 2, mutually overlapping printed products 3 wound up thereupon as well as a winding band or partitioning strap 5 wound in between the winding or coil layers 4. The outermost coil or coils of the winding band 5 are designated by the reference numeral 5'. In FIG. 2 only the outermost of the windings or coil layers 4 are indicated, while in FIG. 1 these windings or coil layers 4 are not represented. As shown in FIG. 2, the printed products 3 have a greater width a than the winding core or mandrel 8, whose width is designated by the reference character b. The printed products 3 therefore protrude beyond the winding core 2 on both sides. In other words, the winding core or mandrel 2 is recessed in relation to the end faces 6 and 7 of the printed product coil or wound product package 1 at both of its ends.

The winding core or mandrel 2 comprises a hollow cylindrical winding body 8 which is open on both end faces. Two mutually spaced open annular or circumferential webs 10 and 11 which protrude in the radial direction from the interior side 9 of the winding body 8 are present on the interior side 9 of the winding body 8. These open annular webs 10 and 11 lie in the planes E and E' which extend perpendicular to the longitudinal axis 2*a* of the winding core 2 and at a distance from the center of gravity S of the coil 1. It is of course conceivable to provide only one such web. Annular grooves, for instance, which open toward the interior side of the winding body 8 can be provided in the winding body 8 instead of webs 10 and 11.

Figure 3:
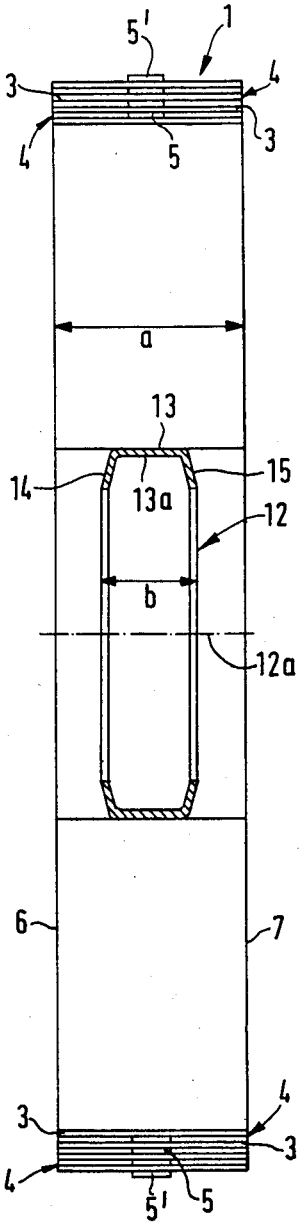
FIGS. 3 and 4 show coils with other embodiments of the winding core in a sectional representation corresponding to FIG. 2.

The printed product coil or wound product package 1 shown in FIG. 3 corresponds to the printed product coil 1 according to the FIGS. 1 and 2 with the exception of the configuration of the winding core or mandrel 12. The winding core or mandrel 12 of the printed product coil 1 according to FIG. 3 comprises an annular web 13 whose inner surface is constructed as a support surface 13*a*. This support surface 13*a* is laterally limited by a side flange 14, 15 which is directed inwardly from web 13, i.e. toward the longitudinal axis 12*a* of the winding core 12. These side flanges 14 and 15 do not form a right angle with the web 13, but are oriented somewhat to the side.

Figure 4:
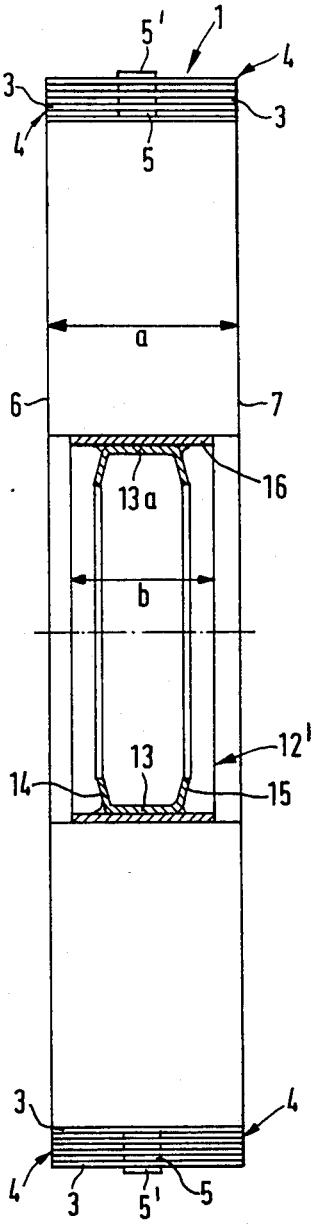

The winding core or mandrel 12' of the printed product coil shown in FIG. 4 largely corresponds to the winding core or mandrel 12 according to FIG. 3. In relation to the winding core or mandrel 12 shown in FIG. 3, the winding core or mandrel 12' of the printed product coil 1 represented in FIG. 4 additionally comprises an annular bearing surface 16 which is arranged on the exterior side of the web 13 of the winding core or mandrel 12' and protrudes laterally beyond this web 13. In this manner it can be achieved that the wound-up printed products 3 can rest upon a greater area without the annular web 13 having to be made wider.

For forming the printed product coil or wound product package 1 shown in the FIGS. 1 through 4, the printed products 3 arriving in imbricated formation are wound-up conjointly with the winding band or strap 5 maintained under tension upon the winding core or mandrel 2, 12 or 12', as is described in more detail in the German Pat. No. 3,123,888. The printed product coils 1 or wound product packages formed in this manner are very compact and the tightly restrained and therefore radially highly compressed coil layers lie intimately together. Due to this compactness of the printed products coil 1 there is no danger that the wound-up printed products 3 will be damaged although they are not supported over their entire width a by the winding core 2, 12, 12', since, as already mentioned, these winding cores 2, 12, 12' are less wide than the printed products 3.

The usually heavy printed product coils 1 can be manipulated without great difficulty, as will be explained in the following in relation to the FIGS. 5 through 9.

Figure 5:
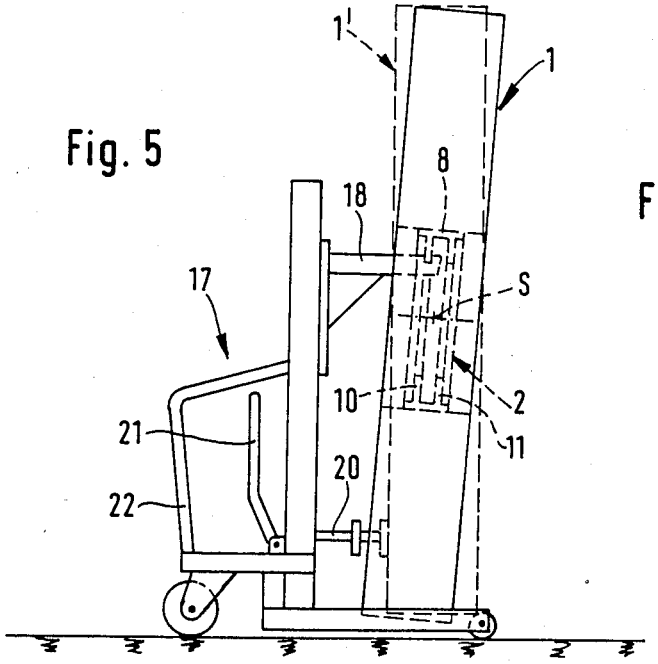
FIG. 5 shows a transport device with a product coil according to FIGS. 1 and 2 in side view.
Figure 6:
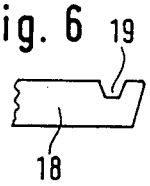
FIG. 6 shows the forward portion of the support arm of the transport device according to FIG. 5 on an enlarged scale in relation to FIG. 5.
Figure 7:
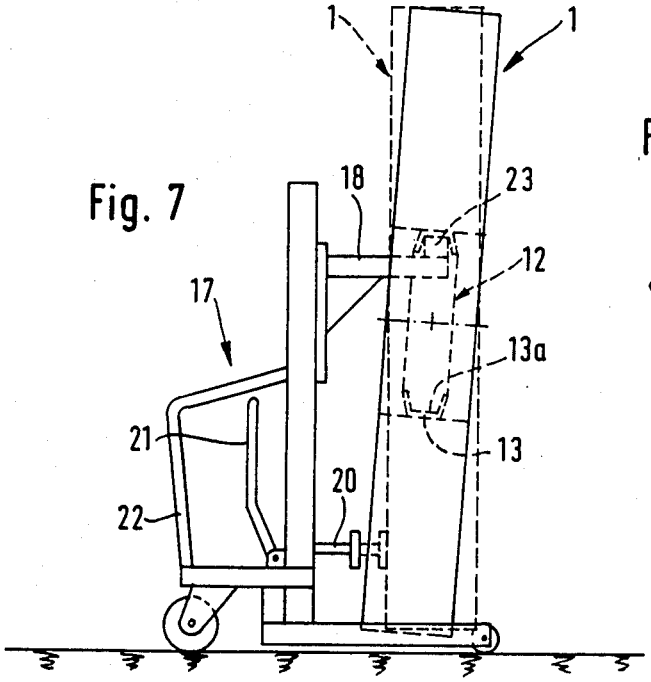
FIG. 7 shows a transport device with a product coil according to FIG. 3 in side view.
Figure 9:
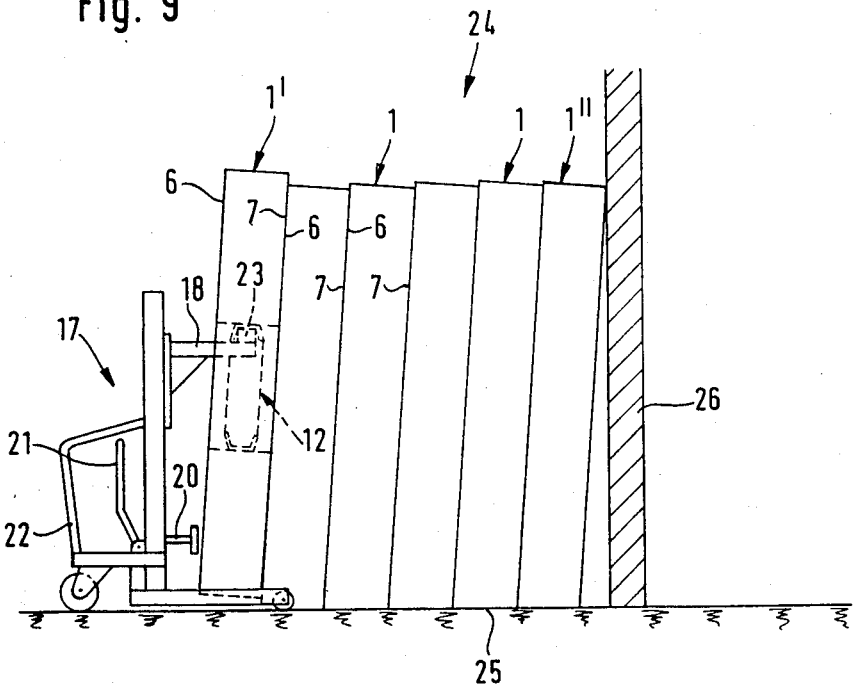
FIG. 9 shows an intermediate storage area for product coils in side view.

In the FIGS. 5, 7 and 9 a transport device 17 for transporting the printed product coils 1 is purely schematically shown, the principle of which is known per se and which is constructed as an elevator lift truck in the present illustrative embodiment. It will, however, be understood that other types of transport devices can also be employed, for instance fork lift trucks. The transport device 17 shown in FIG. 5 comprises a raisable and lowerable support arm 18 which is provided with a receiving groove 19 at one of its ends (FIG. 6). Two adjacently spaced extensible and retractable support members 20 are present beneath the support arm 18, of which only one support member is visible in FIG. 5. The transport device 17 further comprises a manual lever 21 with which the motion of the support arm 18 as well as of the support member 20 can be controlled. Two handlebars 22 serve for manually displacing the transport device 17, of which only one handlebar is visible in FIG. 5.

The transport device shown in FIG. 5 serves for transporting printed product coils or wound product packages 1 in the manner shown in the FIGS. 1 and 2. For lifting the printed product coil 1, the support arm 18 is extended so far into this printed product coil 1 until the groove 19 is situated in the region of the open annular web 10. As the support arm 18 is raised, the open annular web 10 comes to lie in the groove 19 of the support arm 18. Since, as already mentioned, this open annular web 10 is arranged at a distance from the center of gravity S of the printed product coil 1, the printed product coil 1 assumes the tilted position shown in solid lines in FIG. 5 when the support members 20 are retracted. In order to inhibit swinging of the printed product coil 1 during transport, the support members 20 are extended so far that the printed product coil 1 is tipped somewhat in the direction toward the vertical and can support itself against the support members 20, as represented dotted in FIG. 5.

If the winding core or mandrel 2 possesses, as mentioned earlier, grooves instead of the open annular webs 10 and 11, then the support arm 18 of the transport device 17 is provided with a protrusion instead of a groove 19, which engages into this groove of the winding core or mandrel 2 for transporting the printed products coil or wound product package 1.

Figure 8:
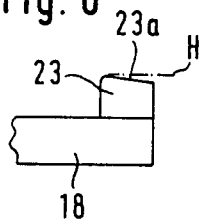
FIG. 8 shows the forward portion of the support arm of the transport device according to FIG. 7 on an enlarged scale in relation to FIG. 7.

The transport device 17 shown in FIG. 7 largely corresponds in its construction to the transport device 17 according to FIG. 5, is however, in relation to the latter, altered to the extent that it is suitable for transporting printed product coils or wound product packages 1 of the type shown in the FIGS. 3 and 4. As FIG. 8 shows, the support arm 18 comprises, instead of a groove 19 at its forward end, a bearing body 23. The latter is provided with a bearing surface 23*a* sloping in relation to the horizontal H and falling forwardly downwardly away from the transport 17. As the support arm 18 is raised, the winding core or mandrel 12 comes to lie on the bearing body 23. Due to the described tilted orientation of the bearing surface 23*a* of this bearing body 23, the printed product coil 1 assumes the tilted position represented in solid lines in FIG. 7 when the support members 20 are retracted. The printed product coil 1 is brought into the position shown dotted in FIG. 7 by extending the support members 20 for transport.

A reclining elongate stack 24 is shown in side view in FIG. 9 which consists of serially juxtaposed printed product coils or wound product packages 1. These printed product coils 1 are tilted in relation to the vertical and supported peripherally upon the floor 25 of a storage space. The forwardmost printed product coil 1″ of the stack 24 leans against a wall 26. Since, as already mentioned, the winding core 2, 12, 12′ is recessed in relation to the end faces 6, 7 of the printed product coil 1, i.e. does not laterally protrude, it is possible to juxtapose the printed product coils 1 such that they are in contact at their end faces 6 or 7 with the end faces 7 or 6 of the neighboring printed product coils 1 practically over the entire end face region. The described construction of the winding cores 2, 12, 12′ and of the transport device 17 permit bringing each printed product coil 1 to be juxtaposed to the existing stack 24 into the appropriate tilted position, as is illustrated in FIG. 9 by the coil designated with 1′. It is therefore possible to juxtapose the printed product coils 1 in intimate contact with one another, i.e. practically without formation of interstices between the end faces 6 and 7 of neighboring coils 1. A minimum of space is therefore required for intermediate storage of printed product coils 1.

While there are shown and described present preferred embodiments of the invention, it is to be distinctly understood that the invention is not limited thereto, but may be otherwise variously embodied and practiced within the scope of the following claims.

Accordingly,

What I claim is:

1. A printed product coil, comprising:

a cylindrical winding core;

printed products wound-up upon said cylindrical winding core;

said printed products having at least one open edge;

a winding band maintained under tension and wound in between the winding layers; and said cylindrical winding core having a lesser width than said printed products to be wound up and being recessed at both ends thereof in relation to end faces of the printed product coil.

2. The printed product coil as defined in claim 1, wherein:

said cylindrical winding core is hollow.

3. The printed product coil as defined in claim 2, wherein:

said cylindrical winding core comprises a hollow cylindrical winding body;

at least one storage element provided on said hollow cylindrical winding body extending along an interior side of said hollow cylindrical winding body in a plane extending substantially perpendicular to the longitudinal axis of said cylindrical winding body and outside the center of gravity of the printed product coil for supporting the printed product coil in radial direction.

4. The printed product coil as defined in claim 3, wherein:

each said at least one storage element is formed by a surrounding open annular web protruding inwardly from said hollow cylindrical winding body.

5. The printed product coil as defined in claim 3, wherein:

each said at least one storage element is formed by an annular groove open toward the interior side of said hollow cylindrical winding body.

6. The printed product coil as defined in claim 3, wherein:

said at least one storage element comprises two storage elements arranged at a distance from one another.

7. The printed product coil as defined in claim 2, wherein:

said cylindrical winding core comprises an annular web having an inner surface constructed as a support surface and from which centrally open annular side flanges extend inwardly towards a longitudinal axis of the cylindrical winding core.

8. The printed product coil as defined in claim 7, further including:

an annular bearing for the printed products protruding laterally beyond said annular web and mounted on an outer side of said annular web.

9. The printed product coil as defined in claim 1, wherein:

said cylindrical winding core comprises means for engaging a transport device; and said means permitting raising and lowering the printed product coil in an orientation tilted in relation to the vertical.

10. The printed product coil as defined in claim 9, wherein:

said lesser width of said cylindrical winding core permits inclined storage of the printed product coil in substantially face to face contact with at least one further printed product coil.

* * * * *

UNITED STATES PATENT AND TRADEMARK OFFICE

CERTIFICATE OF CORRECTION

PATENT NO. : 4,641,795

DATED : February 10, 1987

INVENTOR(S) : WERNER HONEGGER

It is certified that error appears in the above-identified patent and that said Letters Patent are hereby corrected as shown below:

Column 3, line 58 after "coil" please insert --1--

Column 5, line 8, after "transport" please insert --device--

Column 6, line 6, after "claim" please delete "2" and insert --1--

Signed and Sealed this

Twenty-fifth Day of August, 1987

*Attest:*

DONALD J. QUIGG

*Attesting Officer*

*Commissioner of Patents and Trademarks*